US012342929B2

(12) United States Patent
Jacob et al.

(10) Patent No.: US 12,342,929 B2
(45) Date of Patent: Jul. 1, 2025

(54) BRISTLE AND MASCARA BRUSH HAVING SAME

(71) Applicant: SHYA HSIN PACKAGING INDUSTRY (CHINA) CO., LTD., Kunshan (CN)

(72) Inventors: Christophe Jacob, Kunshan (CN); Fuhai Yu, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 429 days.

(21) Appl. No.: 17/852,397

(22) Filed: Jun. 29, 2022

(65) Prior Publication Data

US 2023/0263297 A1 Aug. 24, 2023

(30) Foreign Application Priority Data

Feb. 18, 2022 (CN) ..... 202210153361.4

(51) Int. Cl.
*A46D 1/00* (2006.01)
*A46B 9/02* (2006.01)

(52) U.S. Cl.
CPC ..... *A46B 9/028* (2013.01); *A46D 1/00* (2013.01); *A46B 2200/1053* (2013.01); *A46D 1/0207* (2013.01)

(58) Field of Classification Search
CPC ..... A46D 1/02; A46D 1/023; A46D 1/00
See application file for complete search history.

(56) References Cited

U.S. PATENT DOCUMENTS 2,317,485 A * 4/1943 Rider ..... A46D 1/0261 401/268
2,876,477 A * 3/1959 Stewart ..... A46B 9/04 15/159.1
3,344,457 A * 10/1967 Grobert ..... A46D 1/0238 D25/120
6,390,708 B1 * 5/2002 Gueret ..... A46D 1/0246 401/121
9,681,743 B2 * 6/2017 Xi ..... A46D 1/0215
11,246,405 B2 * 2/2022 Xi ..... A46B 9/04
(Continued)

FOREIGN PATENT DOCUMENTS

CN 1282557 A 2/2001
CN 1290504 A 4/2001
(Continued)

*Primary Examiner* — Michael D Jennings
(74) *Attorney, Agent, or Firm* — Bayramoglu Law Offices LLC

(57) ABSTRACT

A bristle is provided. A first end of the bristle serves as a free end, and a second end of the bristle serves as a root. A cross section of the bristle is in a closed shape defined by at least two lines. Each of the lines is straight or curved. The bristle is twisted along a circumferential direction of its own axis. A mascara brush includes a core and at least one bristle. A root of the bristle is provided on the core, and a free end of the bristle is provided away from the core. A single row of bristles are spaced apart along an axis of the core, or multiple rows of bristles are spaced apart along the axis of the core and arranged radially along a circumferential direction of the core.

10 Claims, 28 Drawing Sheets

(56) References Cited

U.S. PATENT DOCUMENTS

| | | | | |
|---|---|---|---|---|
| 2004/0011375 | A1* | 1/2004 | Dumler | A46D 1/00 132/218 |
| 2004/0035436 | A1* | 2/2004 | Montoli | A45D 40/262 132/218 |
| 2006/0076031 | A1* | 4/2006 | Hartstock | A46B 3/18 132/218 |
| 2009/0276973 | A1* | 11/2009 | Bouix | A46B 9/021 15/207.2 |
| 2018/0235358 | A1* | 8/2018 | Rees | A46D 1/0253 |
| 2018/0344017 | A1* | 12/2018 | Tanaka | A46B 9/028 |
| 2018/0360204 | A1* | 12/2018 | Xi | A46B 9/04 |
| 2020/0139514 | A1* | 5/2020 | Clifford | A46B 9/028 |
| 2020/0154875 | A1* | 5/2020 | Kaicker | A45D 40/262 |
| 2020/0297105 | A1* | 9/2020 | Kaicker | A45D 40/262 |
| 2022/0133016 | A1* | 5/2022 | Garrison | A45D 34/043 |

FOREIGN PATENT DOCUMENTS

| | | | | |
|---|---|---|---|---|
| CN | 105792701 | A | 7/2016 | |
| CN | 213281938 | U | 5/2021 | |
| CN | 114698922 | A | 7/2022 | |
| CN | 217285059 | U | 8/2022 | |
| WO | WO-2012096700 | A1 * | 7/2012 | A46B 9/028 |
| WO | WO-2015085528 | A1 * | 6/2015 | A46B 11/0003 |
| WO | WO-2016054854 | A1 * | 4/2016 | A46B 9/04 |

* cited by examiner

BRISTLE AND MASCARA BRUSH HAVING SAME

CROSS REFERENCE TO THE RELATED APPLICATIONS

This application is based upon and claims priority to Chinese Patent Application No. 202210153361.4, filed on Feb. 18, 2022, the entire contents of which are incorporated herein by reference.

TECHNICAL FIELD

The present disclosure relates to applicators, and in particular to a bristle and a mascara brush having the bristle.

BACKGROUND

Existing mascara brushes are undesirable because material is loaded onto bristles in small amounts at one time. When combing eyelashes, the bristles must be to dipped in the material repeatedly, which is time-consuming. Material from the bristles are poorly adhered to the eyelashes, and there is residue remaining on the bristles after each use, which is undesirable.

SUMMARY

In view of the above defects, the present disclosure provides a bristle. The bristle has the advantages that the eyelashes attach to the bristle more easily, a large amount of the material can be dipped at one time, and the material is applied to the eyelashes more easily. The present disclosure further provides a mascara brush having the bristle.

To solve the technical problems, the present disclosure employs the following technical solutions: A first end of the bristle serves as a free end, and a second end of the bristle serves as a root. A cross section of the bristle is in a closed shape defined by at least two lines. Each of the lines is straight or curved. The bristle is twisted along a circumferential direction of its own axis.

Optionally, the bristle may be twisted entirely, the free end of the bristle may be twisted, the root of the bristle may be twisted, a middle portion of the bristle may be twisted, or both the free end and the root of the bristle may be twisted.

Optionally, the cross section of the bristle may be in a centrosymmetric shape or an axisymmetric shape.

Optionally, the cross section of the bristle may be in any one of a square shape, a cross shape, an I shape, a petaloid shape, an octagon, a rectangle, a rounded rectangle, a triangle, an ellipse, a trapezoid, a convex trapezoid and a concave trapezoid.

Optionally, when the bristle is in any one of the cross shape, the I shape and the octagon, a groove formed by a concave portion on the cross section of the bristle may be a spiral groove.

Optionally, cross-sectional shapes at different heights of the same bristle may be identical, and cross-sectional areas at different heights of the same bristle may be identical or different.

Optionally, a cross-sectional area of the bristle from the root to a tip may be decreased linearly.

Optionally, the bristle may be twisted clockwise along the circumferential direction of its own axis, or twisted counterclockwise along the circumferential direction of its own axis.

Optionally, side edges of the bristle may be located at outward protruding junctions between the two lines of the cross section of the bristle. At least one of the side edges of the bristle may be twisted.

Optionally, all the side edges of the bristle may be twisted; any two of the side edges may be twisted in different angles; or any two of the side edges in a centrosymmetry may be twisted in a same angle.

A mascara brush includes a core and a bristle, where there is at least one bristle. A root of the bristle is provided on the core, and a free end of the bristle is provided away from the core. A single row of bristles are spaced apart along an axis of the core, or multiple rows of bristles are spaced apart along the axis of the core and spaced apart radially along a circumferential direction of the core. Two adjacent rows of bristles are parallel to each other or staggered from each other along the axis of the core.

Optionally, the same row of bristles may be identical in shape, and two adjacent rows of bristles may have an identical twisted direction or different twisted directions.

Optionally, the mascara brush may include one core. The bristles having at least one shape may be provided on the core. A shape feature of the bristles may include at least one of a shape of a cross section, a number of twisted side edges, a twisted position, a twisted angle and a twisted direction.

Optionally, the core may be rod-like. The bristle may be provided at a first end of the core. A side section of the core may be rectangular at a second end and isosceles trapezoidal at the first end.

The present disclosure achieves the following beneficial effects. A first end of the bristle serves as a free end, and a second end of the bristle serves as a root. A cross section of the bristle is in a closed shape defined by at least two lines. Each of the lines is straight or curved. The bristle is twisted along a circumferential direction of its own axis. As the bristle is twisted along its own axis, there is an arc groove at a side of the bristle and thus the material is better adhered on the bristle. With the arc groove, the bristle is more suitable for eyelashes, and applies a large amount of the material onto the eyelashes more easily. The bristle has the advantages that the eyelashes attach to the bristle more easily, a large amount of the material can be dipped at one time, and the material is applied to the eyelashes more easily. The present disclosure further provides a mascara brush, including a core and a bristle. There is at least one bristle. A root of the bristle is provided on the core, and a free end of the bristle is provided away from the core. A single row of bristles are spaced apart along an axis of the core, or multiple rows of bristles are spaced apart along the axis of the core and arranged radially along a circumferential direction of the core. The mascara brush having the bristle achieves the same technical effects as the bristle.

1: bristle, 2: core.

DETAILED DESCRIPTION OF THE EMBODIMENTS

In order to understand the technical means of the present disclosure more clearly and implement the technical means according to contents in the specification, specific implementations of the present disclosure will be further described below in detail with reference to the accompanying drawings and embodiments. The embodiments described below are intended to illustrate the present disclosure, rather than limit the scope of the present disclosure.

Embodiment 1

Figure 1:
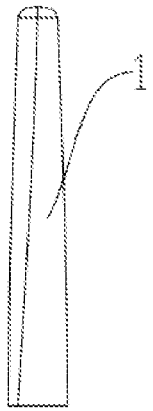
FIG. 1 is a front view illustrating that a bristle is twisted entirely according to the present disclosure.
Figure 2:
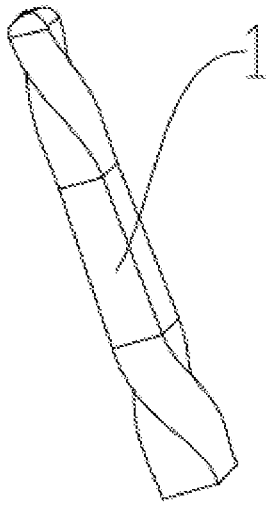
FIG. 2 is a stereoscopic view illustrating that both a free end and a root of a bristle are twisted according to the present disclosure.
Figure 3:
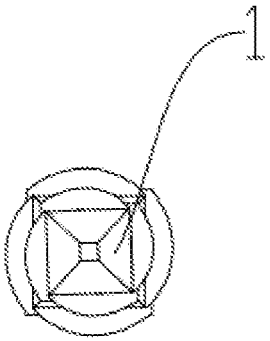
FIG. 3 is a top view illustrating that both a free end and a root of a bristle are twisted according to the present disclosure.
Figure 4:
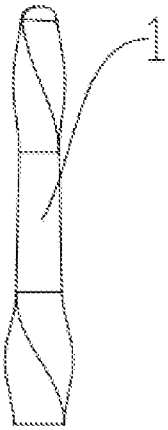
FIG. 4 is a front view illustrating that both a free end and a root of a bristle are twisted according to the present disclosure.
Figure 5:
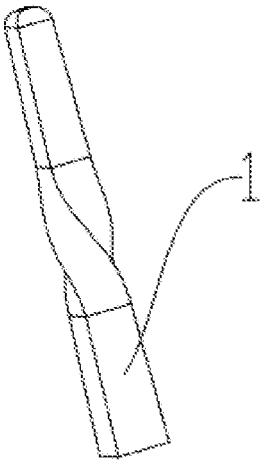
FIG. 5 is a stereoscopic view illustrating that a middle portion of a bristle is twisted according to the present disclosure.
Figure 6:
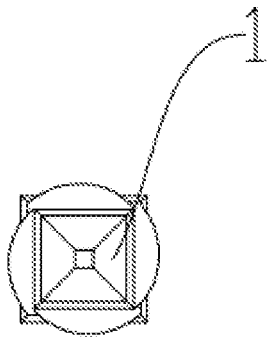
FIG. 6 is a top view illustrating that a middle portion of a bristle is twisted according to the present disclosure.
Figure 7:
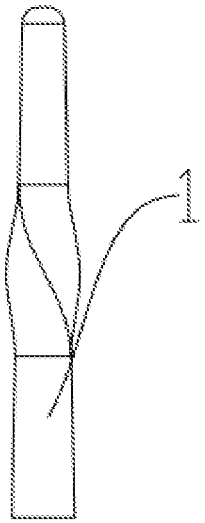
FIG. 7 is a front view illustrating that a middle portion of a bristle is twisted according to the present disclosure.
Figure 8:
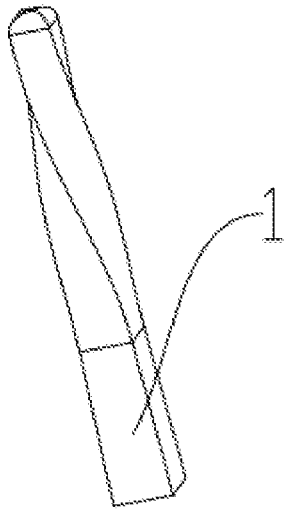
FIG. 8 is a stereoscopic view illustrating that both a free end and a middle portion of a bristle are twisted according to the present disclosure.
Figure 9:
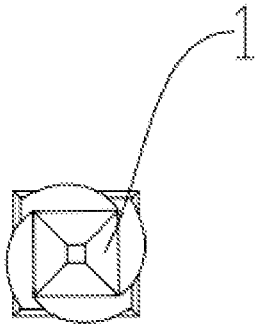
FIG. 9 is a top view illustrating that both a free end and a middle portion of a bristle are twisted according to the present disclosure.
Figure 10:
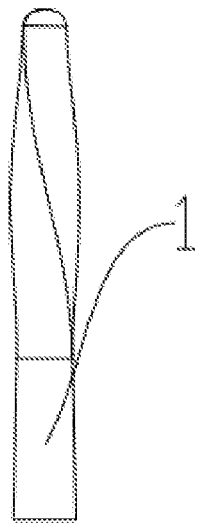
FIG. 10 is a front view illustrating that both a free end and a middle portion of a bristle are twisted according to the present disclosure.
Figure 11:
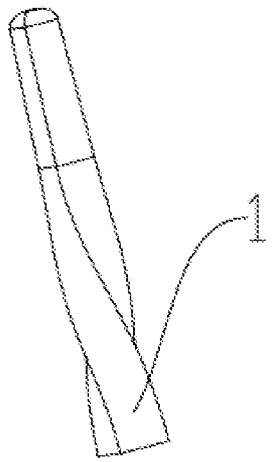
FIG. 11 is a stereoscopic view illustrating that a root and a middle portion of a bristle are twisted according to the present disclosure.
Figure 12:
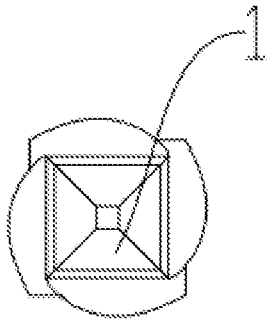
FIG. 12 is a top view illustrating that a root and a middle portion of a bristle are twisted according to the present disclosure.
Figure 13:
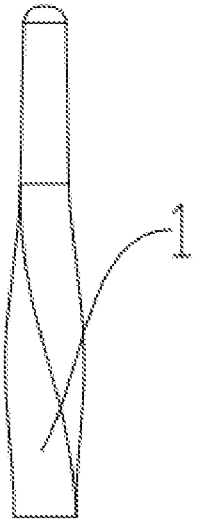
FIG. 13 is a front view illustrating that a root and a middle portion of a bristle are twisted according to the present disclosure.
Figure 14:
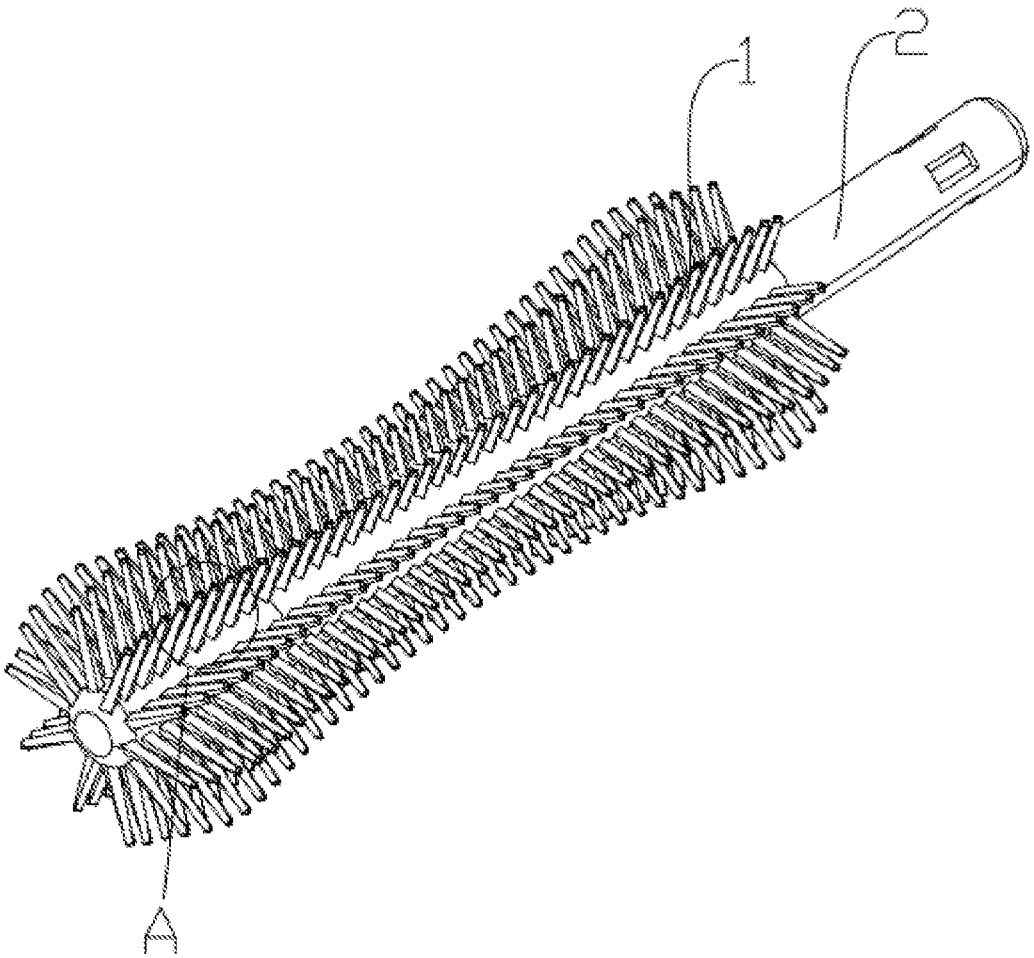
FIG. 14 is a stereoscopic view of a mascara brush having a bristle according to Embodiment 1 of the present disclosure.
Figure 15:
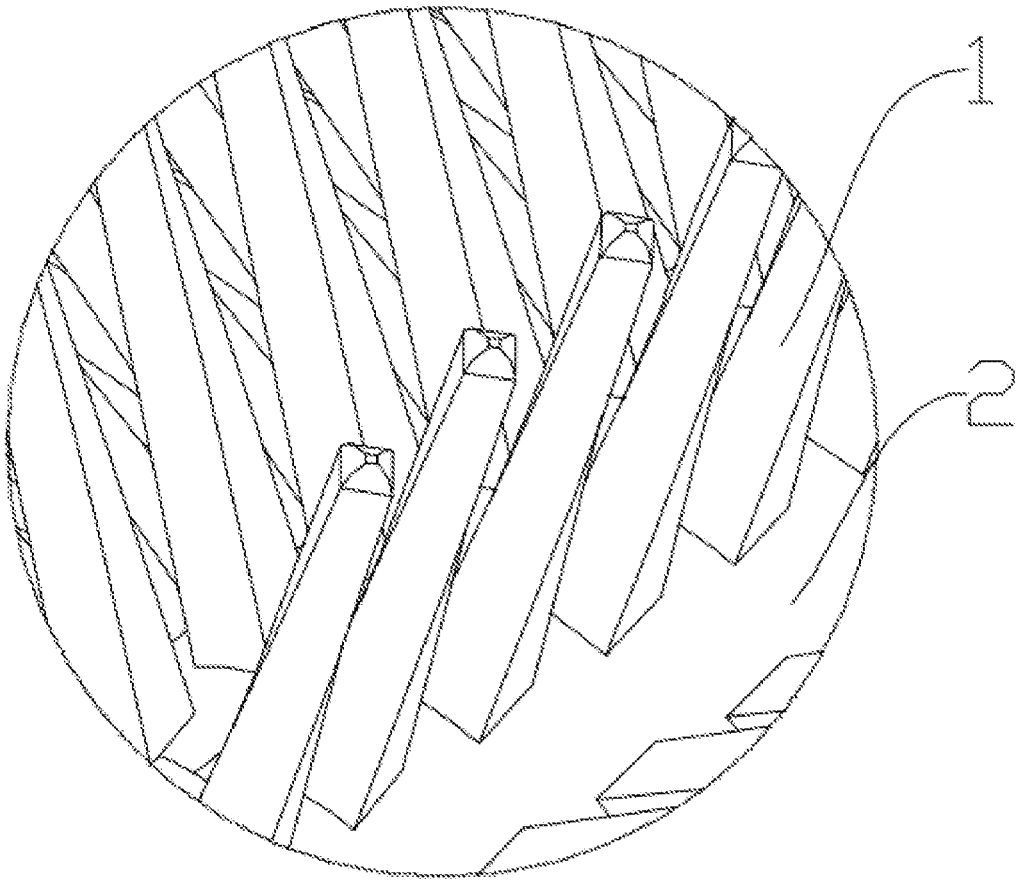
FIG. 15 is an enlarged view of a position A in FIG. 14.
Figure 16:
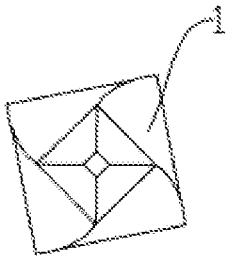
FIG. 16 is a top view of a bristle according to Embodiment 1 of the present disclosure.
Figure 17:
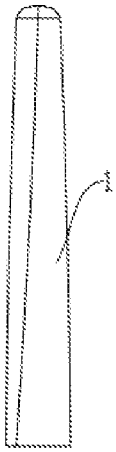
FIG. 17 is a front view of a bristle according to Embodiment 1 of the present disclosure.

As shown in FIGS. 1-17, the present disclosure provides a bristle and a mascara brush. The mascara brush includes a core 2 and the bristle 1. The core 2 is rod-like, with a rectangular side section. The bristle 1 is provided at a first end of the core 2. A fixing mechanism is provided at a second end of the core 2. A cross section of the core 2 is circular or elliptical. In the embodiment, the cross section of the core 2 is circular. There is at least one bristle 1. A first end of the bristle 1 serves as a free end, and a second end of the bristle 1 serves as a root. The root of the bristle 1 is provided on the core 2, while the free end of the bristle 1 is provided away from the core 2. A single row of bristles 1 are spaced apart along an axis of the core 2, or multiple rows of bristles 1 are spaced apart along the axis of the core 2 and spaced apart radially along a circumferential direction of the core 2. When there are multiple rows of bristles 1, the bristles 1 are arranged into 14 rows, 16 row or 18 rows or the like. It is noted that the row number into which the bristles 1 are arranged is an exemplary illustration, rather than a specific limitation to the present disclosure. In the embodiment, there are 10 rows of bristles. Two adjacent rows of bristles 1 are parallel to each other or staggered from each other along the axis of the core 2. In the embodiment, two adjacent rows of bristles 1 are staggered from each other.

In a specific implementation, by staggering two adjacent rows of bristles 1 from each other, a better combing effect and a better layering effect can be achieved. The bristle 1 is twisted along a circumferential direction of its own axis. A twisted angle of the bristle 1 is in a range of (0°, 360°], such as 30°, 60°, 90°, 180° or 270°. In the embodiment, the twisted angle of the bristle 1 is 45°. It is noted that the twisted angle of the bristle 1 is an exemplary illustration, rather than a specific limitation to the present disclosure.

In a specific implementation, as the bristle 1 is twisted along the circumferential direction of its own axis, the material such as a mascara is better adhered on the bristle 1. Meanwhile, the twisted bristle 1 is more suitable for the eyelashes, such that the eyelashes attach to the bristle 1 more easily, a large amount of the material can be dipped at one time, and the material is applied to the eyelashes more easily. The mascara brush having the bristle achieves the same technical effects as the bristle 1. Optionally, the bristle 1 is twisted entirely, the free end of the bristle 1 is twisted, the root of the bristle 1 is twisted, a middle portion of the bristle 1 is twisted, or both the free end and the root of the bristle 1 are twisted. It is noted that the twisted position of the bristle 1 is an exemplary illustration, rather than a specific limitation to the present disclosure. In the embodiment, the bristle 1 is twisted entirely.

Optionally, the cross section of the bristle 1 is in a centrosymmetric shape or an axisymmetric shape. In the embodiment, the cross section of the bristle 1 is of the centrosymmetric shape.

Optionally, the cross section of the bristle 1 is in any one of a square shape, a cross shape, an I shape, a petaloid shape, an octagon, a rectangle, a rounded rectangle, a triangle, an ellipse, a trapezoid, a convex trapezoid and a concave trapezoid. It is noted that the cross section of the bristle 1 is an exemplary illustration, rather than a specific limitation to the present disclosure. In the embodiment, the cross section of the bristle 1 is square.

Optionally, cross-sectional shapes at different heights of the same bristle 1 are identical, and cross-sectional areas at different heights of the same bristle 1 are identical or different. In the embodiment, the cross section close to the root is greater than that close to the free end for the same bristle 1.

In a specific implementation, the cross section close to the root is greater than that close to the free end for the same bristle 1, such that the eyelashes can be guided to gaps between the bristles 1 more easily for combing. Optionally, a cross-sectional area of the bristle 1 from the root to a tip is decreased linearly.

Optionally, the bristle 1 is twisted clockwise along the circumferential direction of its own axis, or twisted counterclockwise along the circumferential direction of its own axis. In the embodiment, the bristle 1 is twisted counterclockwise along the circumferential direction of its own axis.

Optionally, side edges of the bristle 1 are located at outward protruding junctions between the two lines of the cross section of the bristle 1. At least one of the side edges of the bristle 1 is twisted. A twisted angle of the side edge is in a range of (0°, 360° ], such as 30°, 60°, 90°, 180° or 270°. In the embodiment, the twisted angle of the side edge is 45°. It is noted that the twisted angle of the side edge is an exemplary illustration, rather than a specific limitation in the present disclosure. In the embodiment, each side edge of the bristle 1 is twisted.

Optionally, all the side edges of the bristle 1 are twisted; any two of the side edges are twisted in different angles; or any two of the side edges in a centrosymmetry are twisted in a same angle. In the embodiment, any two of the side edges in a centrosymmetry are twisted in a same angle.

Optionally, the same row of bristles 1 are identical in shape, and two adjacent rows of bristles 1 have an identical twisted direction or different twisted directions. In the embodiment, two adjacent rows of bristles 1 have an identical twisted direction.

Optionally, the mascara brush includes one core 2. The bristles 1 having at least one shape are provided on the core 2. A shape feature of the bristles 1 includes at least one of a shape of a cross section, a number of twisted side edges, a twisted position, a twisted angle and a twisted direction. It is noted that the shape of the bristle 1 is an exemplary illustration, rather than a specific limitation to the present disclosure. In the embodiment, the core 2 includes the bristles 1 having one shape.

In the embodiment, the mascara brush is manufactured by a process including integrated injection molding, such as injection molding, glue injection, or blow molding in a molding cycle. It is noted that the mascara brush in the embodiment may further be manufactured by another process, which is not limited by the present disclosure.

In the embodiment, the mascara brush is made of a material including plastic or acrylonitrile-butadiene rubber. It is noted that the mascara brush in the embodiment may further be made of another material, which is not limited by the present disclosure.

Embodiment 2

Figure 18:
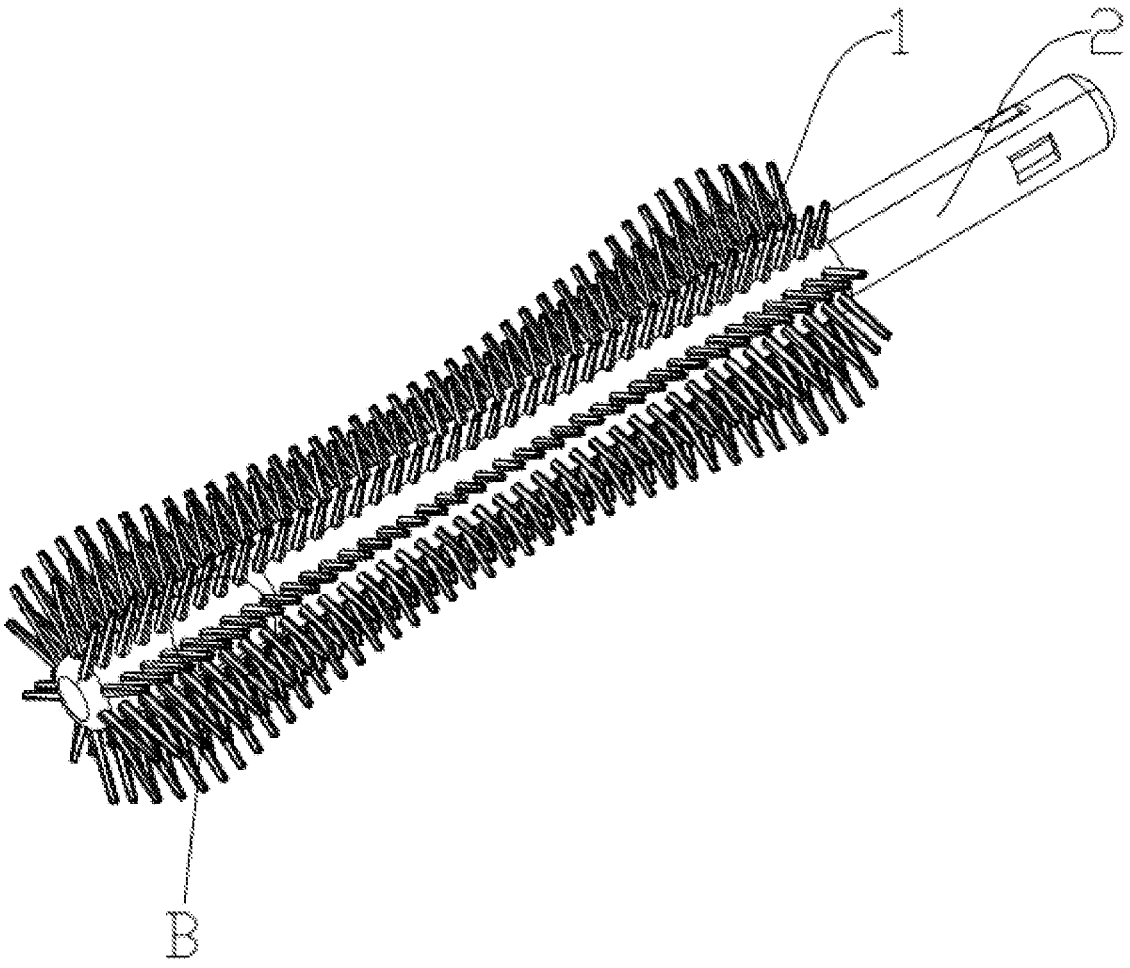
FIG. 18 is a stereoscopic view of a mascara brush having a bristle according to Embodiment 2 of the present disclosure.
Figure 19:
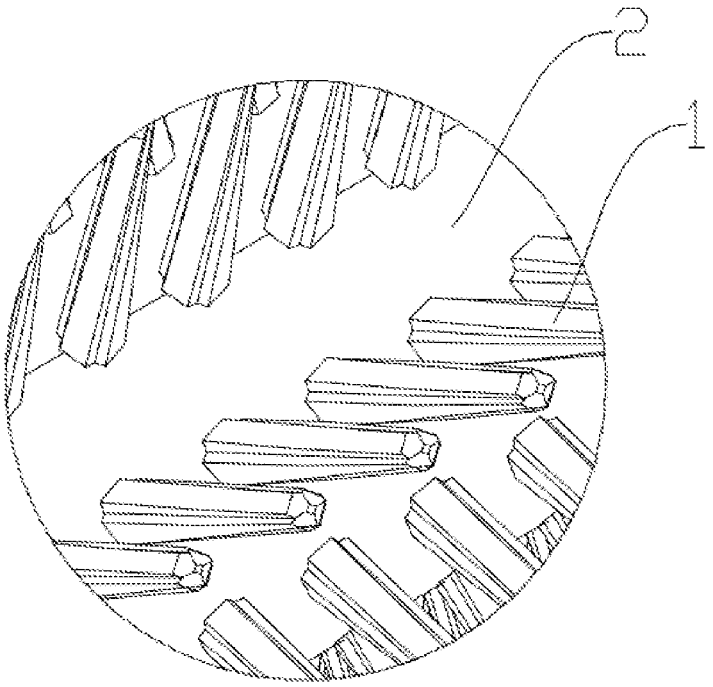
FIG. 19 is an enlarged view of a position B in FIG. 18.
Figure 20:
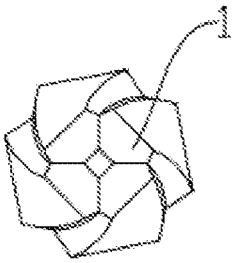
FIG. 20 is a top view of a bristle according to Embodiment 2 of the present disclosure.
Figure 21:
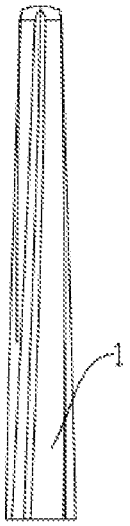
FIG. 21 is a front view of a bristle according to Embodiment 2 of the present disclosure.

As shown in FIGS. 18-21, Embodiment 2 improves upon Embodiment 1. In Embodiment 2, the cross section of the bristle 1 is cross-shaped.

Optionally, a groove formed by a concave portion on the cross section of the bristle 1 is a spiral groove.

In a specific implementation, with the spiral groove, the material can be better adhered on the bristle 1. Moreover, the eyelashes can also be embedded into the spiral groove for the better application effect.

Embodiment 3

Figure 22:
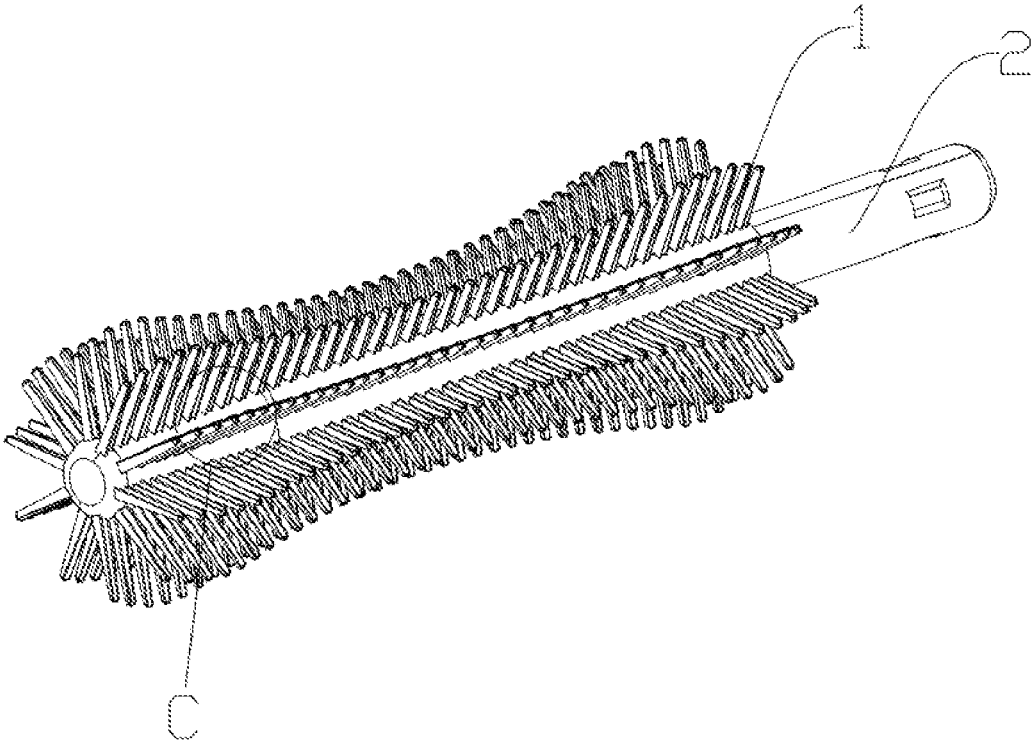
FIG. 22 is a stereoscopic view of a mascara brush having a bristle according to Embodiment 3 of the present disclosure.
Figure 23:
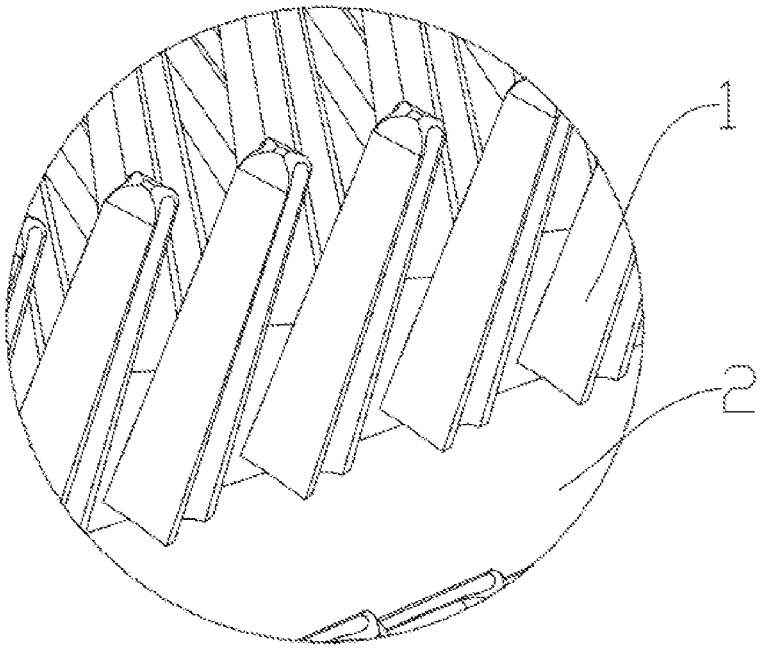
FIG. 23 is an enlarged view of a position C in FIG. 22.
Figure 24:
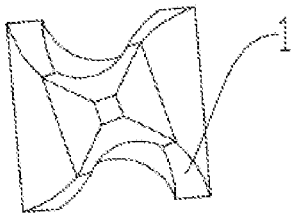
FIG. 24 is a top view of a bristle according to Embodiment 3 of the present disclosure.
Figure 25:
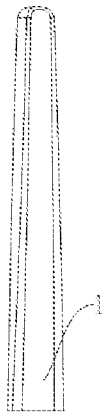
FIG. 25 is a front view of a bristle according to Embodiment 3 of the present disclosure.

As shown in FIGS. 22-25, Embodiment 3 improves upon Embodiment 1. In Embodiment 3, the cross section of the bristle 1 is I-shaped (double-bean-shaped).

Embodiment 4

Figure 26:
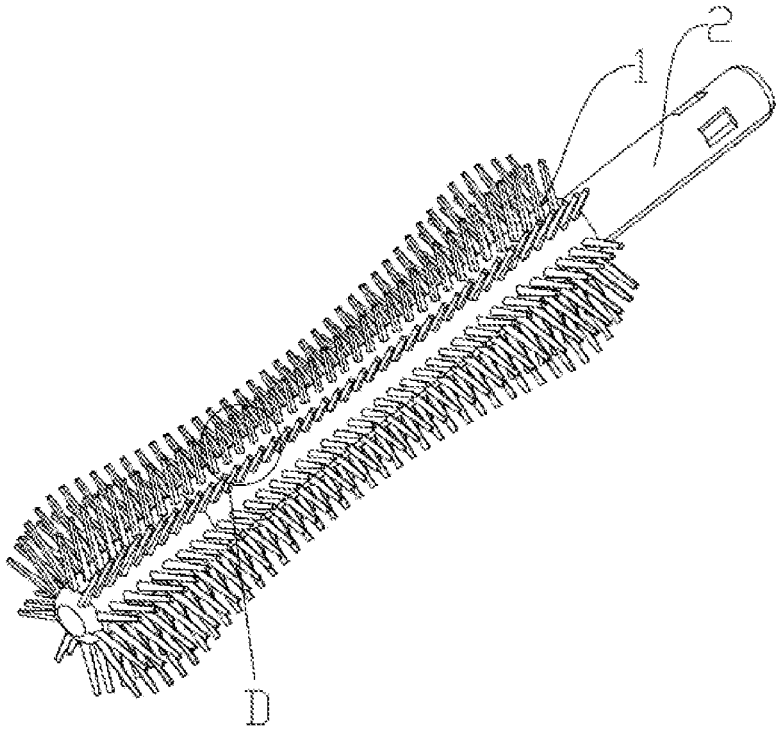
FIG. 26 is a stereoscopic view of a mascara brush having a bristle according to Embodiment 4 of the present disclosure.
Figure 27:
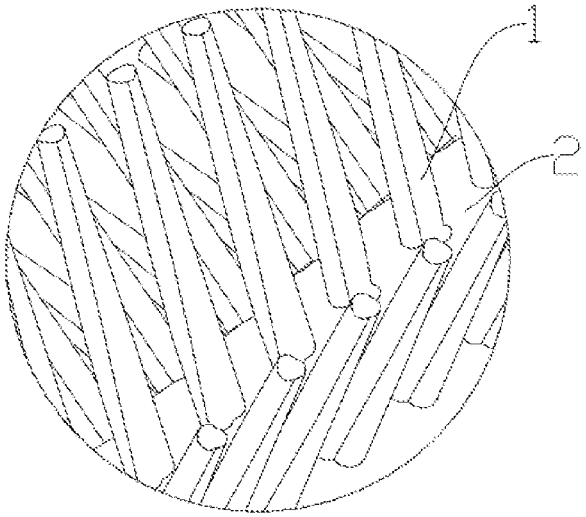
FIG. 27 is an enlarged view of a position D in FIG. 26.
Figure 28:
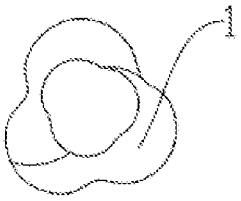
FIG. 28 is a top view of a bristle according to Embodiment 4 of the present disclosure.
Figure 29:
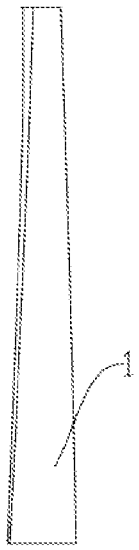
FIG. 29 is a front view of a bristle according to Embodiment 4 of the present disclosure.

As shown in FIGS. 26-29, Embodiment 4 improves upon Embodiment 1. In Embodiment 4, the cross section of the bristle 1 is petaloid shaped.

Embodiment 5

Figure 30:
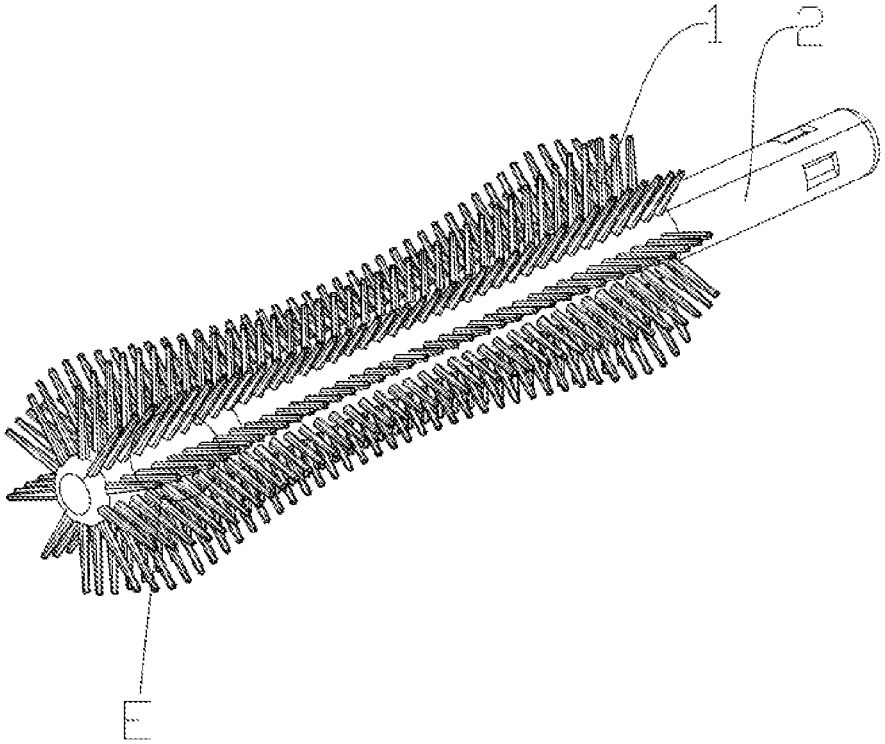
FIG. 30 is a stereoscopic view of a mascara brush having a bristle according to Embodiment 5 of the present disclosure.
Figure 31:
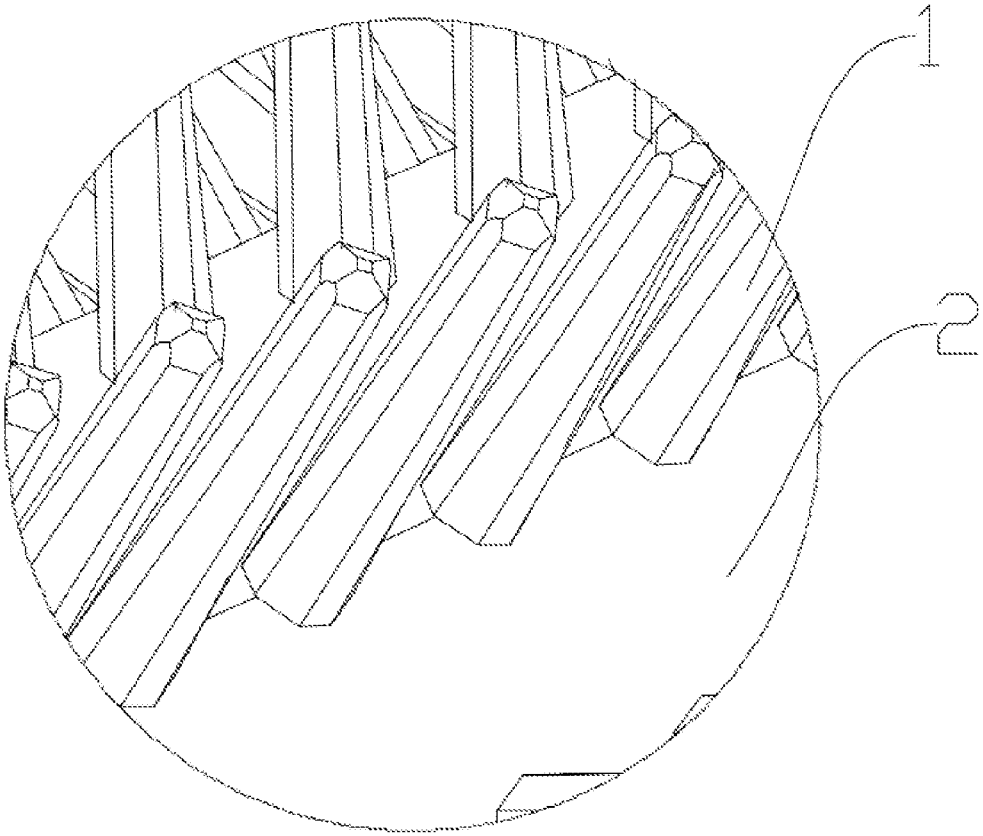
FIG. 31 is an enlarged view of a position E in FIG. 30.
Figure 32:
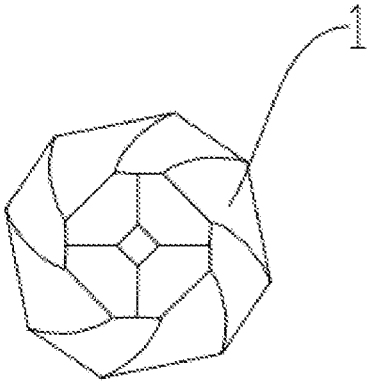
FIG. 32 is a top view of a bristle according to Embodiment 5 of the present disclosure.
Figure 33:
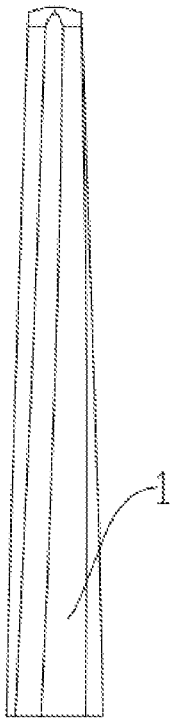
FIG. 33 is a front view of a bristle according to Embodiment 5 of the present disclosure.

As shown in FIGS. 30-33, Embodiment 5 improves upon Embodiment 1. In Embodiment 5, the cross section of the bristle 1 is octagonal.

Embodiment 6

Figure 34:
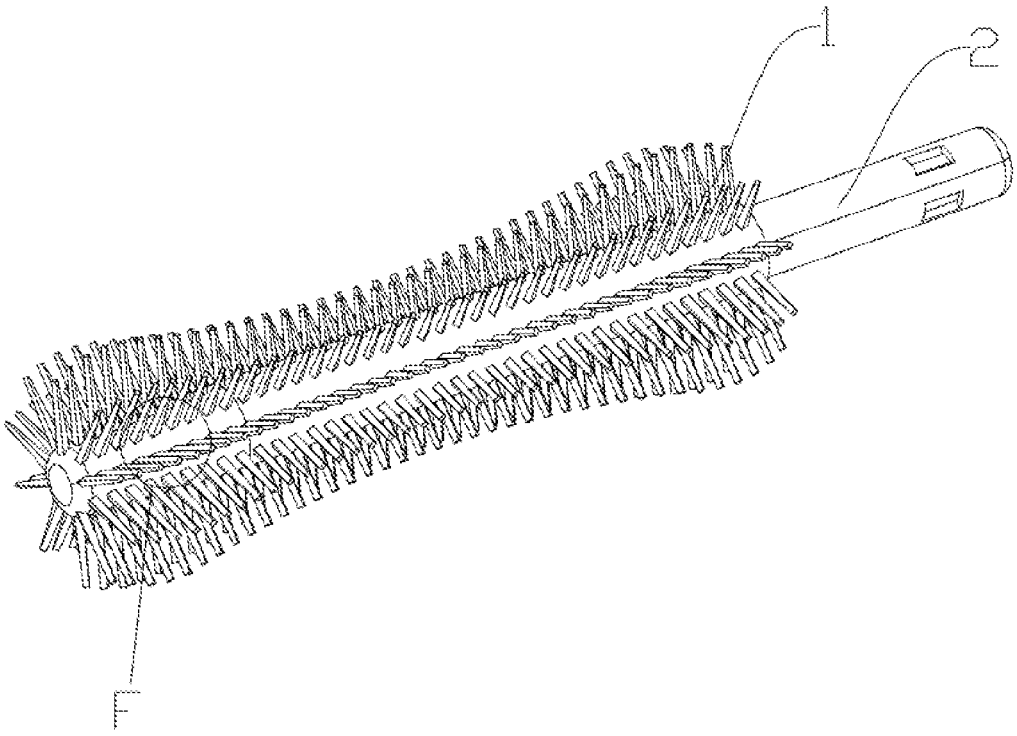
FIG. 34 is a stereoscopic view of a mascara brush having a bristle according to Embodiment 6 of the present disclosure.
Figure 35:
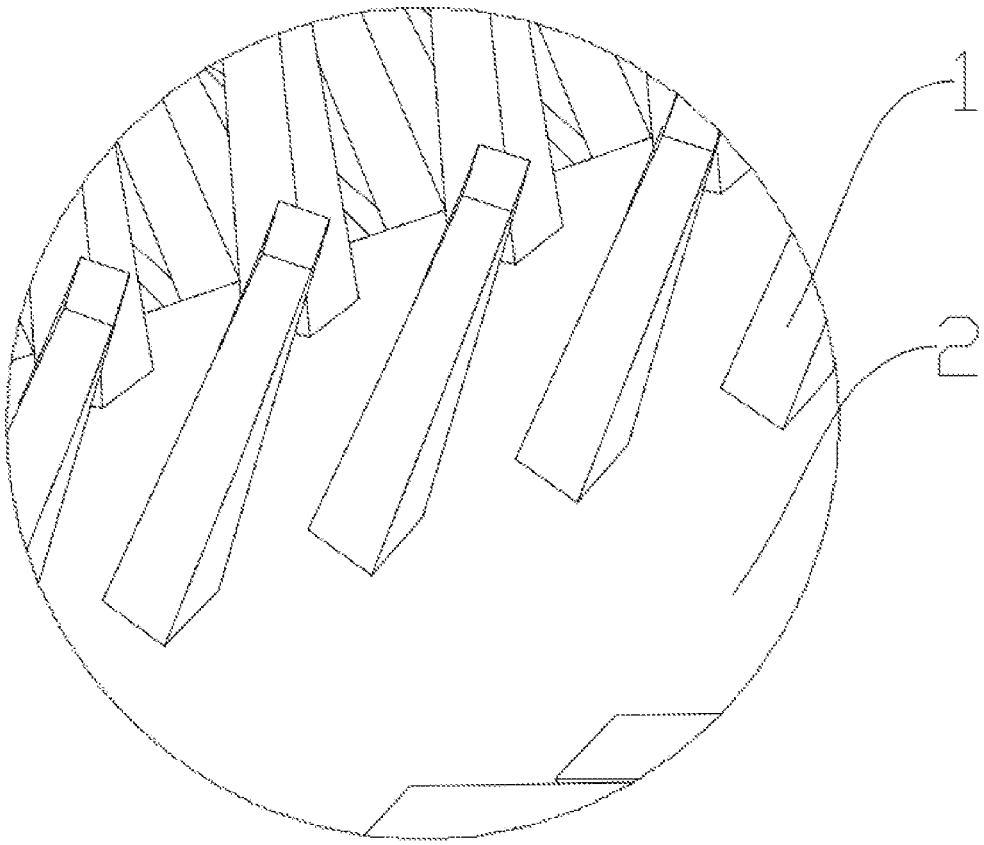
FIG. 35 is an enlarged view of a position F in FIG. 34.
Figure 36:
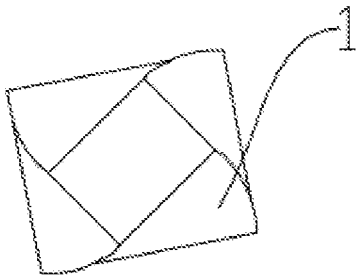
FIG. 36 is a top view of a bristle according to Embodiment 6 of the present disclosure.
Figure 37:
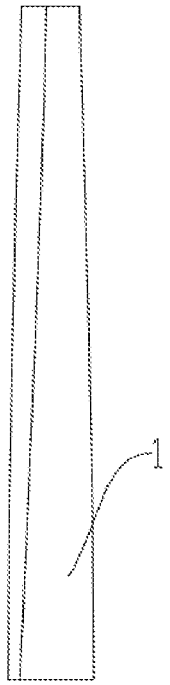
FIG. 37 is a front view of a bristle according to Embodiment 6 of the present disclosure.

As shown in FIGS. 34-37, Embodiment 6 improves upon Embodiment 1. In Embodiment 6, the cross section of the bristle 1 is rectangular.

Embodiment 7

Figure 38:
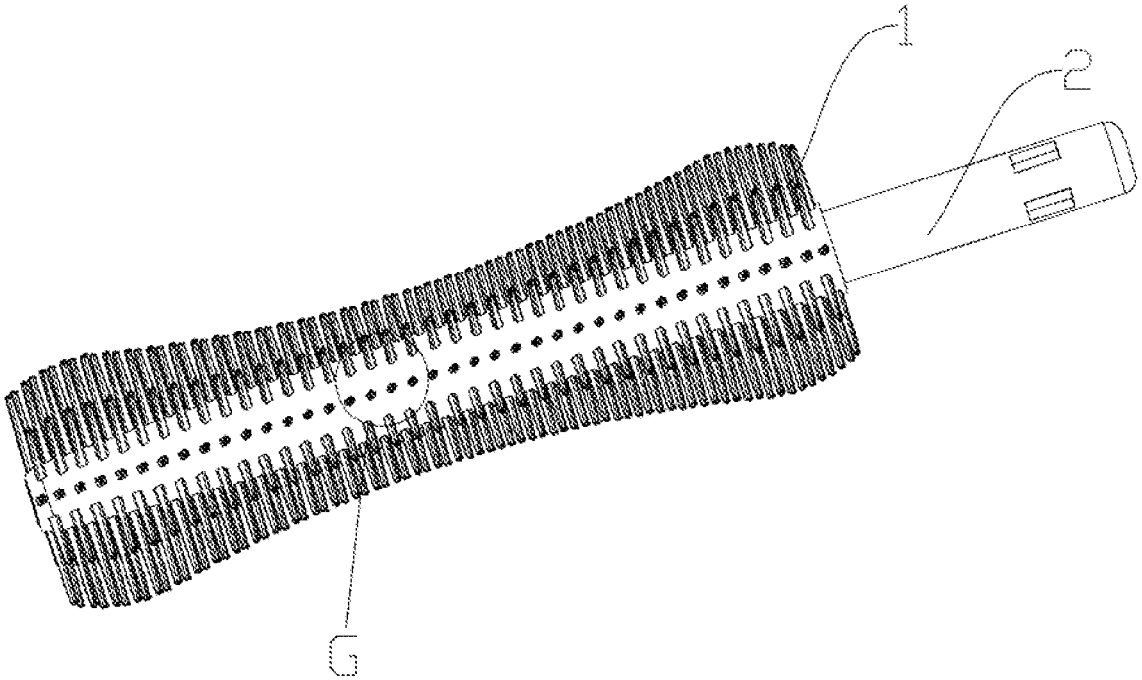
FIG. 38 is a stereoscopic view of a mascara brush having a bristle according to Embodiment 7 of the present disclosure.
Figure 39:
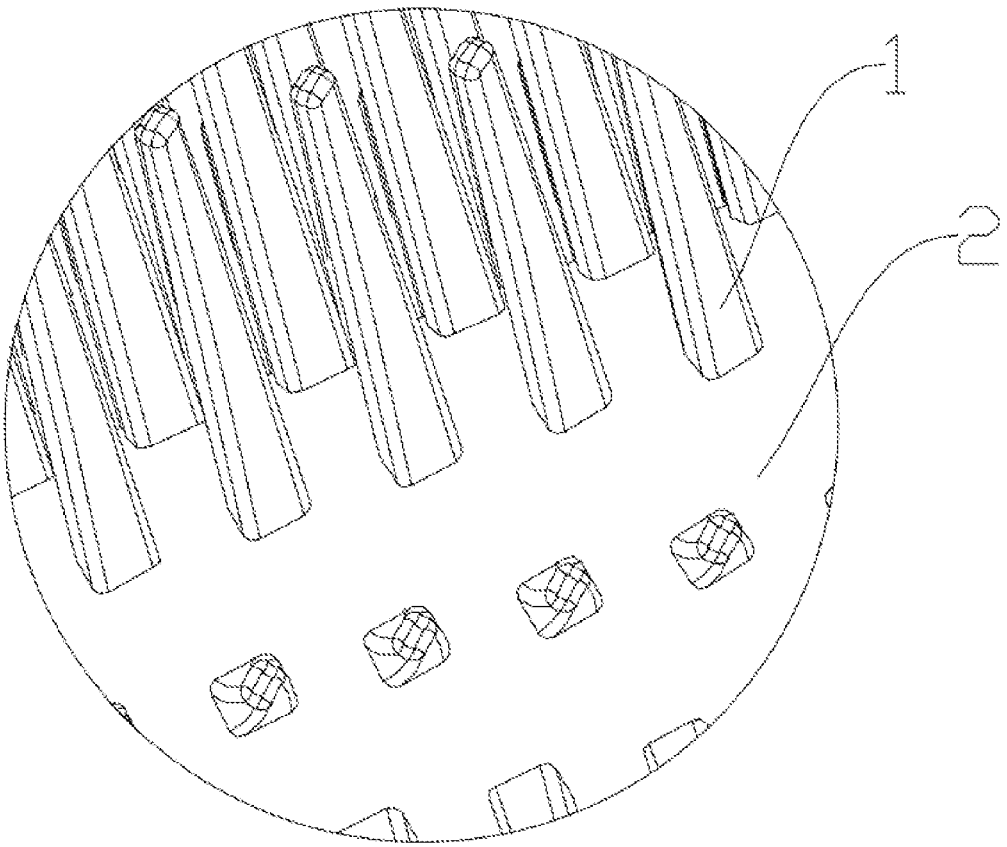
FIG. 39 is an enlarged view of a position G in FIG. 38.
Figure 40:
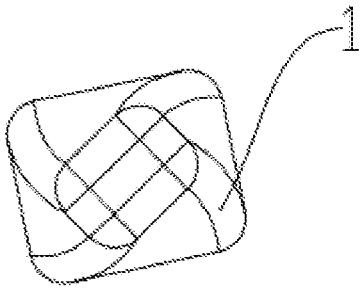
FIG. 40 is a top view of a bristle according to Embodiment 7 of the present disclosure.
Figure 41:
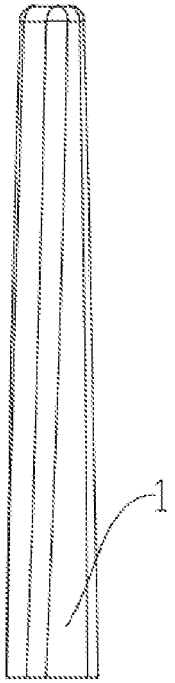
FIG. 41 is a front view of a bristle according to Embodiment 7 of the present disclosure.

As shown in FIGS. 38-41, Embodiment 7 improves upon Embodiment 1. In Embodiment 7, the cross section of the bristle 1 is rounded rectangular.

Embodiment 8

Figure 42:
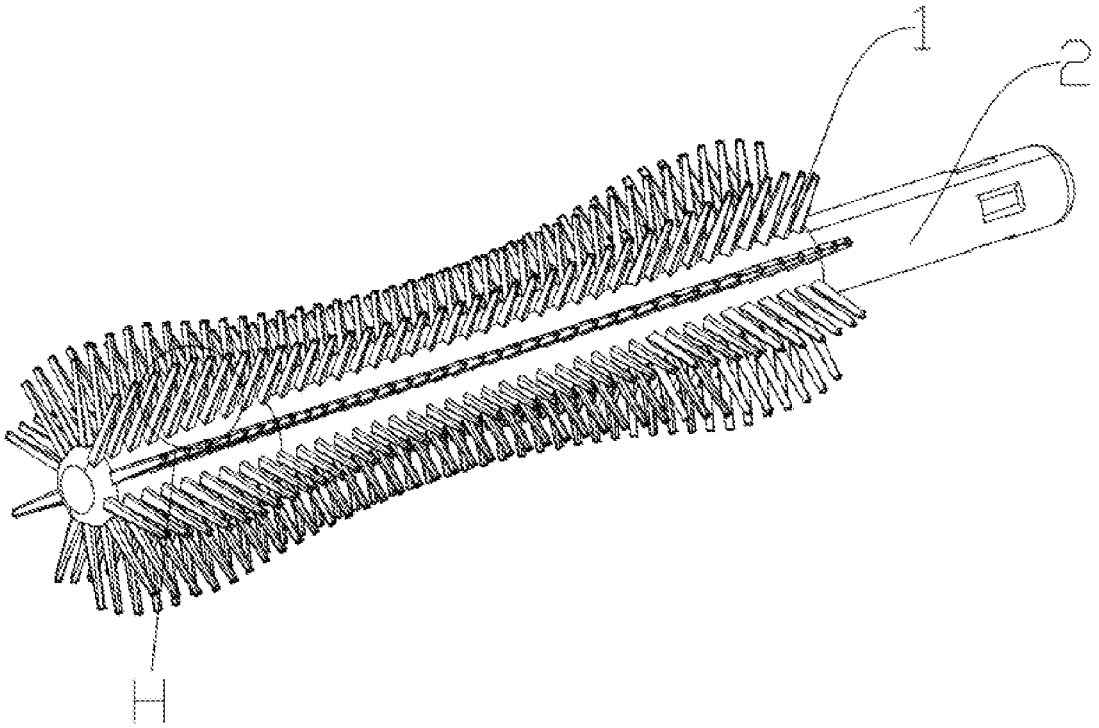
FIG. 42 is a stereoscopic view of a mascara brush having a bristle according to Embodiment 8 of the present disclosure.
Figure 43:
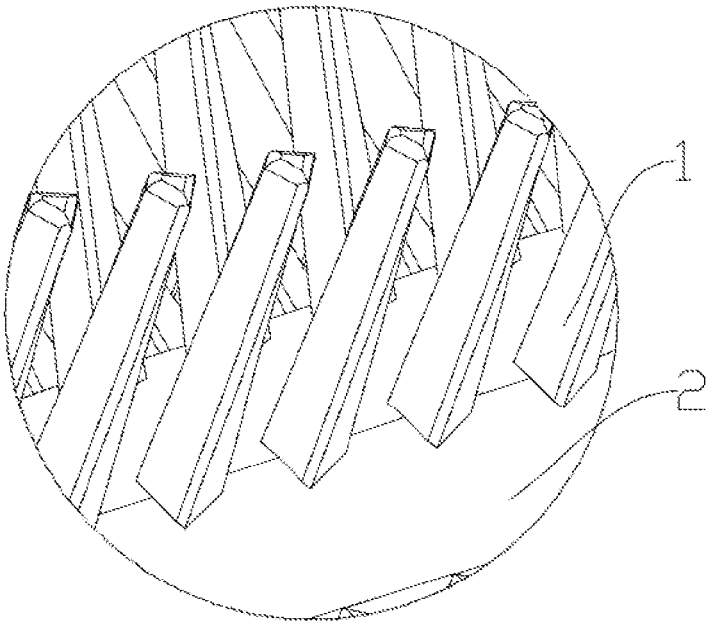
FIG. 43 is an enlarged view of a position H in FIG. 42.
Figure 44:
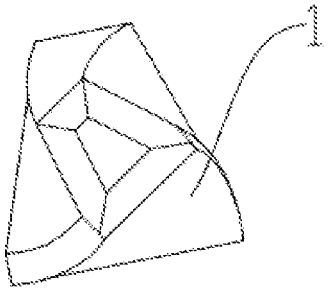
FIG. 44 is a top view of a bristle according to Embodiment 8 of the present disclosure.
Figure 45:
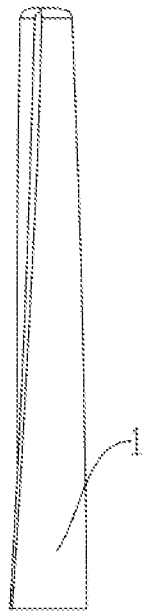
FIG. 45 is a front view of a bristle according to Embodiment 8 of the present disclosure.

As shown in FIGS. 42-45, Embodiment 8 improves upon Embodiment 1. In Embodiment 8, the cross section of the bristle 1 is trapezoidal.

Embodiment 9

Figure 46:
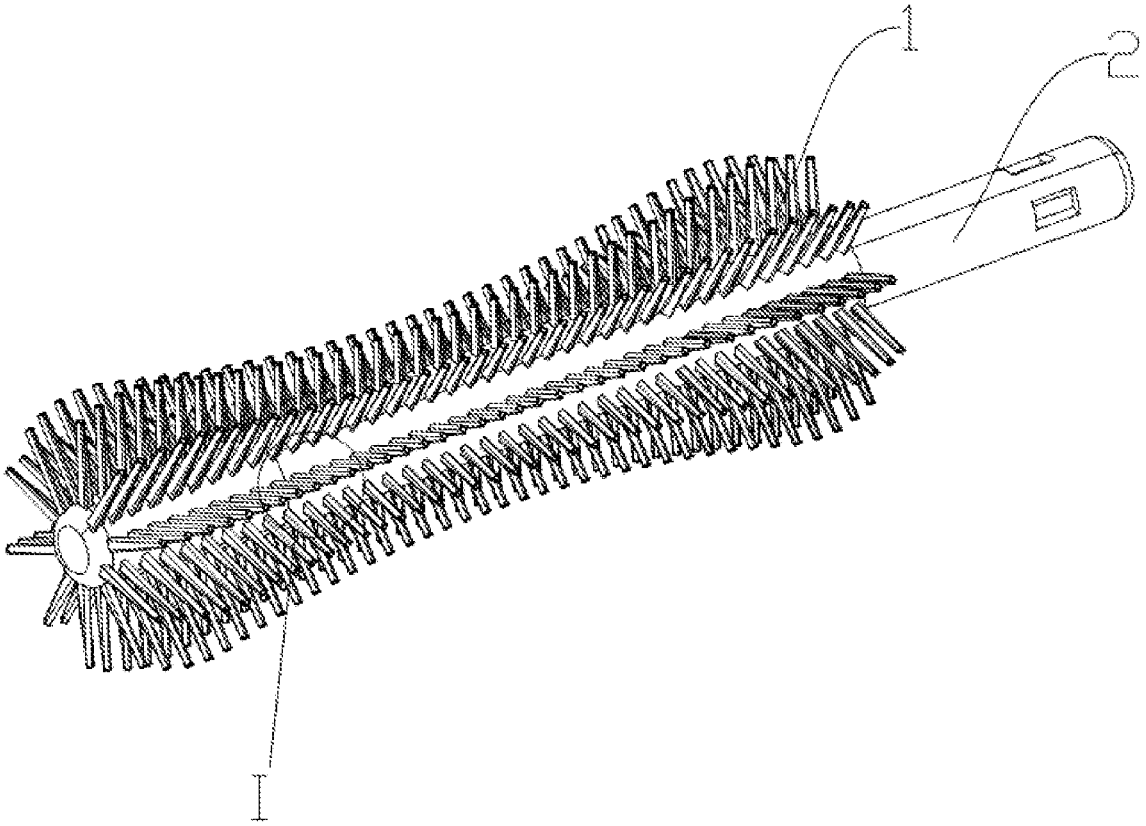
FIG. 46 is a stereoscopic view of a mascara brush having a bristle according to Embodiment 9 of the present disclosure.
Figure 47:
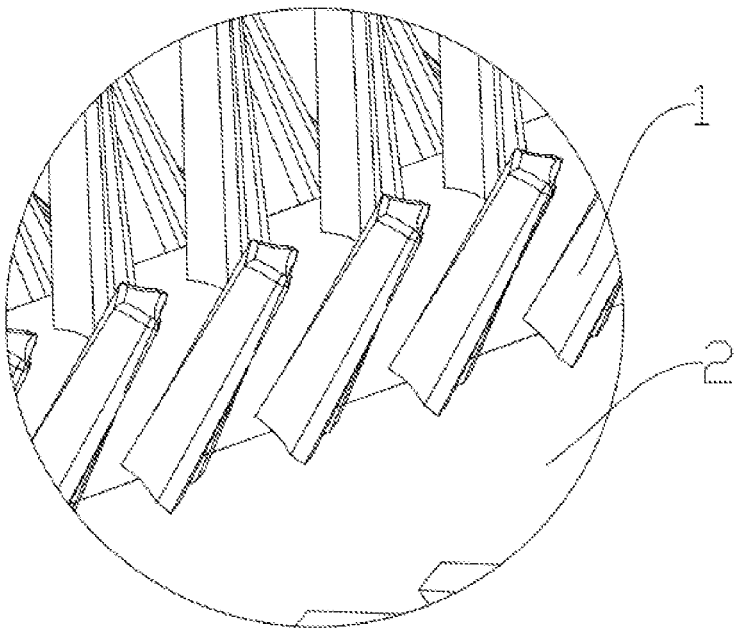
FIG. 47 is an enlarged view of a position I in FIG. 46.
Figure 48:
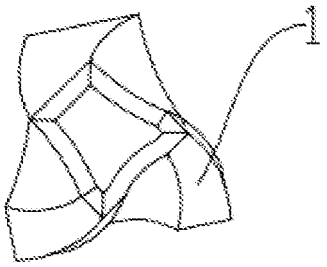
FIG. 48 is a top view of a bristle according to Embodiment 9 of the present disclosure.
Figure 49:
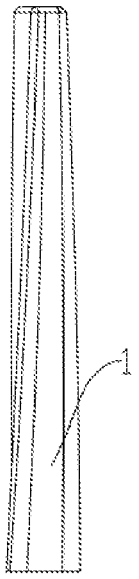
FIG. 49 is a front view of a bristle according to Embodiment 9 of the present disclosure.

As shown in FIGS. 46-49, Embodiment 9 improves upon Embodiment 1. In Embodiment 9, the cross section of the bristle 1 is concavely trapezoidal.

Embodiment 10

Figure 50:
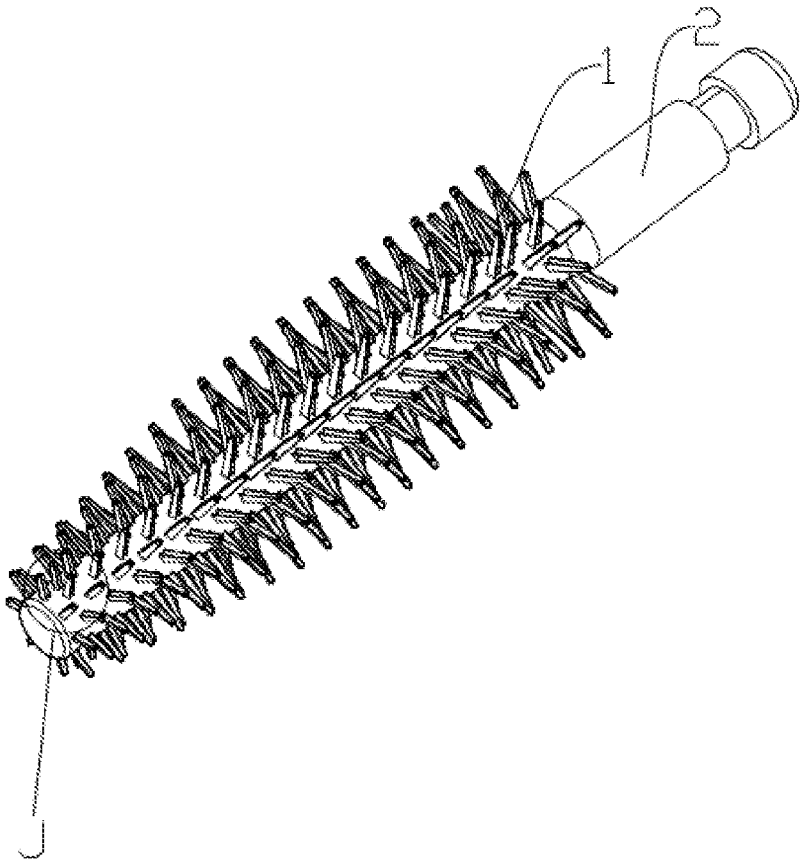
FIG. 50 is a stereoscopic view of a mascara brush having a bristle according to Embodiment 10 of the present disclosure.
Figure 51:
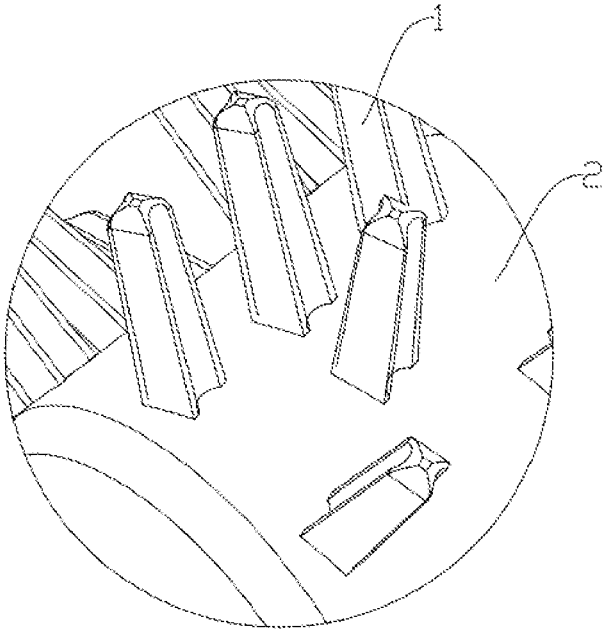
FIG. 51 is an enlarged view of a position J in FIG. 50.
Figure 52:
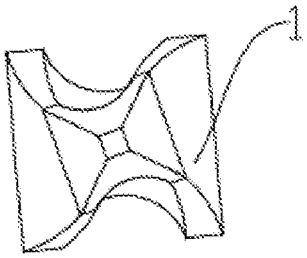
FIG. 52 is a top view of a bristle according to Embodiment 10 of the present disclosure.
Figure 53:
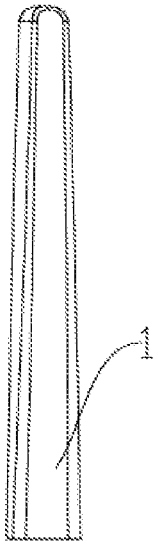
FIG. 53 is a front view of a bristle according to Embodiment 10 of the present disclosure.

As shown in FIGS. 50-53, Embodiment 10 improves upon Embodiment 3. In Embodiment 10, the core 2 may be rod-like. The bristle 1 is provided at the first end of the core 2. A side section of the core 2 is rectangular at the second end and isosceles trapezoidal at the first end. The first end of the core 2 refers to a side with the bristle 1, while the second end of the core 2 refers to a side without the bristle 1.

In a specific implementation, by providing the side section of the first end as the isosceles trapezoid, the bristle 1 is arranged more reasonably to improve the application effect of the mascara brush.

The foregoing embodiments are preferred embodiments of the present disclosure and are described in detail with reference to the accompanying drawing. Various modifications or changes made by those skilled in the art to the above embodiments should fall within the protection scope of the present disclosure without departing from the essence of the present disclosure.

What is claimed is:

1. A mascara brush, comprising a core and a set of bristles, wherein a first end of each bristle of the set of bristles serves as a free end, and a second end of the bristle serves as a root, wherein the root of the bristle is provided on the core, and the free end of the bristle is provided away from the core; wherein the mascara brush includes at least one of: a single row of bristles spaced apart along an axis of the core, or multiple rows of bristles spaced apart along the axis of the core and spaced apart radially along a circumferential direction of the core; and wherein at least one of: two adjacent rows of bristles are parallel to each other, or two adjacent rows of bristles are staggered from each other along the axis of the core.

2. The mascara brush according to claim 1, wherein a same row of bristles are identical in shape, and the two adjacent rows of bristles have an identical twisted direction or different twisted directions.

3. The mascara brush according to claim 1, wherein the mascara brush comprises one core; bristles having at least one shape are provided on the core; and a shape feature of the bristles comprises at least one selected from the group consisting of a shape of a cross section, a number of twisted side edges, a twisted position, a twisted angle and a twisted direction.

4. The mascara brush according to claim 1, wherein the core is rod-like; the bristle is provided at a first end of the core; and a side section of the core is rectangular at a second end, and isosceles trapezoidal at the first end.

5. The mascara brush according to claim 1, wherein the bristle is twisted entirely, the free end of the bristle is twisted, the root of the bristle is twisted, a middle portion of the bristle is twisted, or the free end and the root of the bristle are twisted.

6. The mascara brush according to claim 1, wherein the cross section of the bristle is in a centrosymmetric shape or an axisymmetric shape.

7. The mascara brush according to claim 6, wherein the cross section of the bristle is in any one selected from the group consisting of a square shape, a cross shape, an I shape, a petaloid shape, an octagon, a rectangle, a rounded rectangle, a triangle, an ellipse, a trapezoid, a convex trapezoid and a concave trapezoid.

8. The mascara brush according to claim 7, wherein when the bristle is in any one selected from the group consisting of the cross shape, the I shape and the octagon, a groove formed by a concave portion on the cross section of the bristle is a spiral groove.

9. The mascara brush according to claim 7, wherein cross-sectional shapes at different heights of a same bristle are identical, and cross-sectional areas at different heights of the same bristle are identical or different.

10. The mascara brush according to claim 6, wherein a cross-sectional area of the bristle from the root to a tip is decreased linearly.

* * * * *